United States Patent [19]

O'Connor

[11] Patent Number: 4,688,875

[45] Date of Patent: Aug. 25, 1987

[54] SPRING CONTACT STRUCTURE

[75] Inventor: Robert J. O'Connor, Greenfield, Ind.

[73] Assignees: American Telephone and Telegraph Company; AT&T Information Systems, Inc., both of Murray Hill, N.J.

[21] Appl. No.: 907,848

[22] Filed: Sep. 15, 1986

[51] Int. Cl.[4] ..... H01R 13/34

[52] U.S. Cl. ..... 439/676; 439/81; 439/554

[58] Field of Search ..... 339/17 C, 125 R, 176 R, 339/176 M, 176 MP, 252 R, 252 P

[56] References Cited

U.S. PATENT DOCUMENTS

| | | | |
|---|---|---|---|
| 3,444,502 | 5/1969 | Matthews | 339/17 |
| 3,744,009 | 7/1973 | Teagno et al. | 339/128 |
| 3,794,953 | 2/1974 | Malin | 339/17 |
| 3,842,189 | 9/1974 | Southgate | 174/52 |
| 3,883,207 | 5/1975 | Tomkiewicz | 339/75 |
| 3,885,848 | 5/1975 | Brouneus | 339/17 |
| 4,113,342 | 9/1978 | Andreaggi | 339/176 |
| 4,186,988 | 2/1980 | Kobler | 339/176 |
| 4,262,981 | 4/1981 | Goodman | 339/17 |
| 4,286,835 | 9/1981 | Adams et al. | 339/17 |
| 4,296,991 | 10/1981 | Hughes et al. | 339/176 |
| 4,386,815 | 6/1983 | Carter et al. | 339/17 M |
| 4,422,128 | 12/1983 | Zurlinden et al. | 361/408 |
| 4,457,570 | 7/1984 | Bogese, II | 339/17 |

*Primary Examiner*—Joseph H. McGlynn
*Attorney, Agent, or Firm*—Harry L. Newman

[57] ABSTRACT

A connector is disclosed that includes spring contacts (200) for making a solderless connection to other electrical conductors (310). Each spring contact (200) has a loop contact portion (230) that is supported so that its end regions (232 and 234) are restrained in a direction generally normal to the site of engagement of its arcuate contact surface (236) with the other electrical conductor (310). As a result, the main region (235) of the loop contact portion (230) is essentially rotated rather than compressed when pressed into engagement with the other electrical conductor (310). The desired contact force necessary for a good solderless electric connection is thereby provided.

20 Claims, 6 Drawing Figures

SPRING CONTACT STRUCTURE

FIELD OF THE INVENTION

This invention relates to contacts for electrical connectors and within that field to contacts for making a solderless connection to other electrical conductors such as conductive paths on a printed circuit board.

BACKGROUND OF THE INVENTION

The typical manner in which an electrical connection is established between a discrete conductor and a conductive path on a printed circuit board is by having the discrete conductor pass through a hole that is circumscribed by the conductive path. Solder is then applied to this juncture to envelop both the conductor and the surrounding conductive path and thereby electrically connect one to the other.

An example of this type of connection where the discrete conductor is a contact of a connector is disclosed in U.S. Pat. No. 4,186,988 issued to R. J. Kohler on Feb. 5, 1980. As disclosed in that patent, the connector, which is a jack of the type used in telephones, is mounted on an associated printed circuit board by a multiple of cyndrical locking posts. The posts extend downwardly from a surface of the connector that overlies the printed circuit board, and the posts are accommodated by holes in the printed circuit board, Each post includes an upper portion having a diameter that is slightly less than the diameter of the hole that accommodates it and having a height slightly greater than the thickness of the printed circuit board. In addition, each post includes a lower portion having a diameter somewhat larger than the hole in the printed circuit board. Finally, each post is split longitidinally whereby the sides of the post can be deflected inwardly to permit the lower portion to pass through the accommodating hole and then return to an undeflected state when the upper portion is positioned within the hole. The lower portion of each post thereby serves to secure the connector to the printed circuit board.

Because of tolerance variations in the thickness of printed circuit boards, the height of the upper portion of each locking post has to be slightly greater than the maximum allowable thickness. There is, therefore, some play between the connector and a printed circuit board of lesser thickness. This play is essentially removed when the spring contacts of the connector are soldered to the printed circuit board. Thus, as is typical, the soldered junctions serve to electrically connect and also physically secure the connector to the printed circuit boards.

As a result of the stresses created in performing the securing function and vagaries in the soldering operation, soldered junctions, while generally providing good conductivity, sometimes fail under shock. More significantly, such junctions can sometimes fail in a manner that creates an intermittent open that is difficult to detect. Also of significance in the very competitive world of electronics is that soldering requires an additional processing step that adds to the cost of the product.

For these reasons it is desirable to be able to make a solderless connection to conductive paths on a printed circuit board. A solderless connection, however, relies on intimate engagement in order to obtain the desired conductivity across the interface between the two elements. This intimate engagement is made more difficult by the above described tolerance variations in the thickness of printed circuit boards. Each contact of the component being electrically connected to the printed circuit board must not be stressed beyond its yield point when the associated component is mounted on a printed circuit board of maximum thickness. Yet, each contact must provide the necessary contact force when the associated component is mounted on a printed circuit board of minimum thickness.

SUMMARY OF THE INVENTION

A contact in accordance with the present invention that has this capability comprises a wire spring contact of a connector, such as a jack of the type used in telephones. The jack includes a dielectric housing having a generally rectangular shaped cavity to accommodate a mating plug. The housing further has a planar base portion that serves at the bottom of the cavity and extends laterally both beyond the sides and rear end of the cavity. The bottom surface of the base portion is adapted to overlie the printed circuit board to which each spring contact is to be connected.

Each spring contact comprises a linear contact portion at one end that is joined by an intermediate portion to a loop contact portion at the other end. The linear contact portion extends cantilever fashion within the cavity of the housing and serves to make electrical connection with the corresponding contact of the mating plug. The intermediate portion extends within a groove in the bottom and front end of the base portion and serves to generally locate the linear contact portion. The loop contact portion is located within the base portion to the rear of the cavity and serves to engage and make electrical connection with a conductive path of a printed circuit board.

The loop contact portion includes first and second end regions. The first end region joins the loop contact portion with the intermediate portion and is situated within an opening in the base portion, the opening extending between the top and bottom surfaces of the base portion. The second end region of the loop contact portion extends adjacent to the first end region and is situated within a groove in the bottom of the base portion. The remainder or the main region of the loop contact portion lies within a slot within the base portion that extends between the top and bottom surfaces of the base portion. The main region extends below the bottom surface of the base portion and includes an arcuate contct surface, which is adjacent to the second end region, that provides the site of enagement with the conductive path on the associated printed circuit board.

As a result of this arrangement, the loop contact portion is restrained in a lateral direction between the sides of the slot in the base portion. In addition, both the first and second end regions of the loop contact portion are restrained in a direction generally perpendicular to the conductive path that the loop portion engages. The main region of the loop contact portion, however, is free to be deflected in this direction, and when pressed into engagement with a conductive path, the main region essentially rotates about the first and second end regions.

This arrangement provides a higher contact force than is provided by the typical single cantilever contact spring because loading becomes distributed throughout the circumference of the loop contact portion as deflection takes place. Furthermore, since the main region of the loop contact portion is free to be deflected, it primarily rotates rather than being compressed as is the case, for example, with respect to the contact structure disclosed in U.S. Pat. No. 3,842,189 issued on Oct. 15, 1974 to P. D. Southgate. There is therefore no problem with the contact of this invention being stressed beyond its yield point.

DETAILED DESCRIPTION

Figure 1:
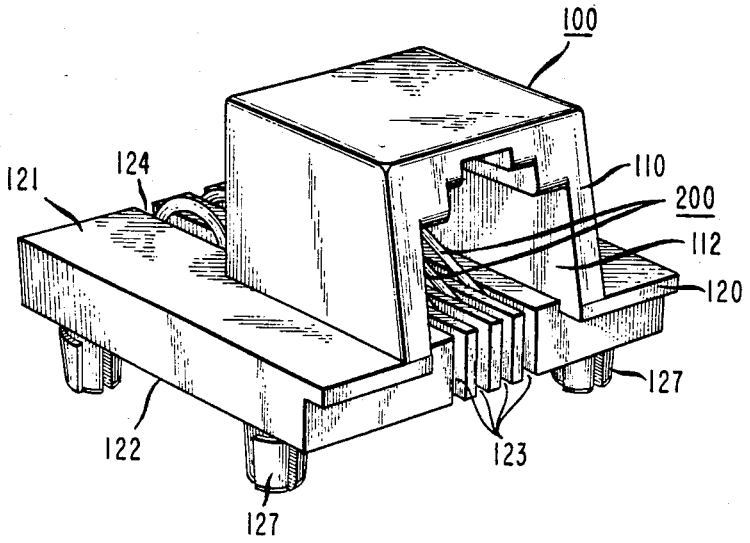
FIG. 1 is a perspective view of an electrical connector embodying the spring contact of the present invention.

Referring to FIG. 1 of the drawing, a connector embodying a spring contact in accordance with the present invention includes a dielectric member 100 for supporting a multiple of spring contacts 200. The support member 100 comprises a housing portion 110 upstanding from a planar base portion 120, the housing portion having a cavity 112 for accommodating a mating connector.

The base portion 120 serves as the bottom of the cavity 112 and extends beyond the sides of and to the rear of the housing portion 110. The base portion 120 has a top surface 121 and a bottom surfce 122, and four parallel planar slots 123 and 124 respectively extend between the top and bottom surfaces at the front and the rear of the base portion.

Figure 2:
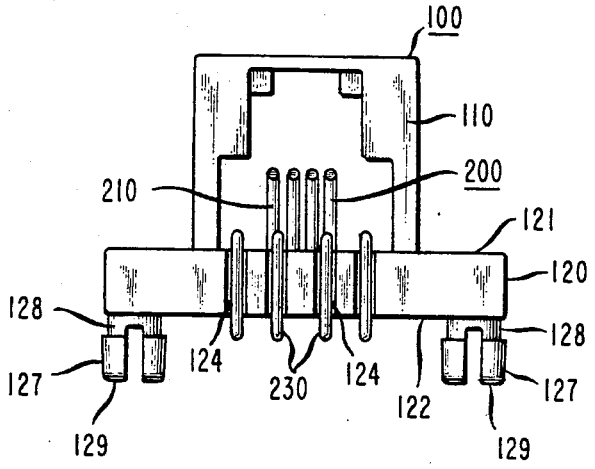
FIG. 2 is a rear elevation of the connector.
Figure 3:
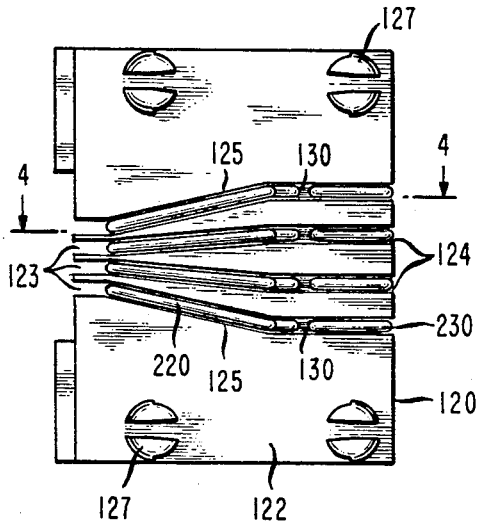
FIG. 3 is a bottom view of the connector.

Referring also to FIGS. 2 and 3, the slots 123 are located within the cavity 112 of the housing portion 110 while the slots 124 are to the rear of the housing portion. In addition, the slots 123 are more closely spaced than the slots 124, the spacing of the slots 123 corresponding to the spacing between the contacts of a modular telephone plug, typically apart, and the spacing of the slots 124 corresponding to the spacing of the conductive paths on a printed circuit board, typically apart.

Four grooves 125 in the bottom surface 122 of the base portion 120 respectively extend from the bottom of the slots 123 and flare laterally outward so that the spacing at the rear end of the grooves corresponds to the spacing of the slots 124. The rear end of each groove 125 communicates with a vertical opening 126 that is opened to the top and bottom of the base portion 120. In addition, four grooves 130 in the bottom surface 122 of the base portion 120 respectively extend between the openings 126 and the slots 124.

Figure 4:
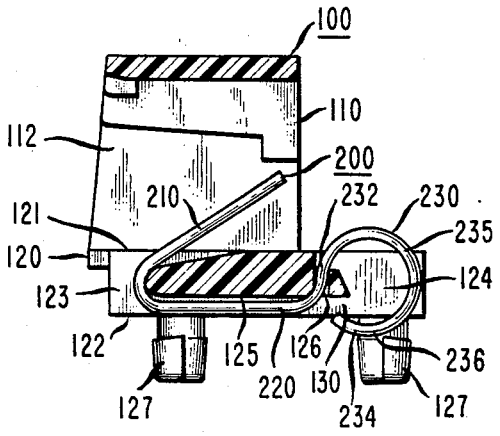
FIG. 4 is a sectional view of the connector taken along line 4—4 of FIG. 3.

As seen most clearly in FIG. 4, each spring contact 200 comprises a linear contact portion 210 at one end that is joined by an intermediate portion 220 to a loop contact portion 230 at the other end. The linear contact portion 210 extends cantilever-fashion within the cavity 112 of the housing portion 110 of support member 100 and serves to make electrical connection with a corresponding contact of a mating plug (not shown). The intermediate portion 220 extends within one of the grooves 125 in the bottom surface 122 and the associated slot 123 in the front end of the base portion 120 and serves to generally locate the linear contact portion 210. The loop contact portion 230 is located within the portion of the base portion 120 to the rear of the housing portion 110 and serves to engage and make solderless electrical connection with a conductive path 310 on an associated printed circuit board 300 shown in FIG. 5.

The loop contact portion 230 includes a first end region 232 and a second end region 234. The first end region 232 joins the loop contact portion 230 with the intermediate portion 220 and is situated within the opening 126 in the base portion 120 to the rear of the groove 125 within which the intermediate portion is situated. The second end region 234 of the loop contact portion 230 extends adjacent to the first end region 232 and is accommodated by the groove 130 in the bottom surface 122 of the base portion 120 to the rear of the opening 126 within which the first end region 232 is situated.

Figure 5:
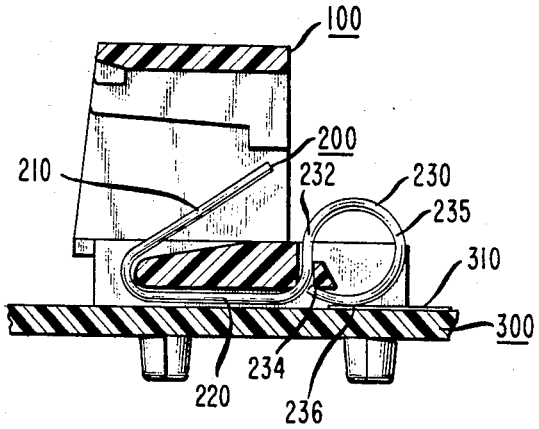
FIG. 5 is the same as FIG. 4 showing the connector mounted on a printed circuit board.

The remainder of the loop contact portion 230 comprises a main region 235 that is partially accommodated within the slot 124 in the base portion 120 that is to the rear of the groove 127 in which the second end region 234 is accommodated. The main region 235 extends below the bottom surface 122 of the base portion 120 and includes an arcuate contact surface 236 which is adjacent to the second end region 234. The contact surface 236 provides the site of engagement with the conductive path 310 on the printed circuit 300 (FIG. 5).

As a result of the foregoing arrangement, the loop contact portion 230 is restrained in a lateral direction between the sides of the slot 124 at the base portion 120. In addition, both the first and second end regions 232 and 234 of the loop contact portion 230 are restrained in a direction generally normal to the site of enagement of the arcuate contact surface 236 with the conductive path 310 on the printed circuit board 300. The main region 235 of the loop contact portion 230, however, is free to be deflected in this direction and, as shown in FIG. 5, when presssed into engagement with the conductive path 310, the main region essentially rotates abut the first and second end regions 232 and 234.

This deflection occurs when the connector is mechanically mounted to the printed circuit board 300 by means of four cylindrical locking posts 127. The posts 127 extend downwardly from the bottom surface 122 of the base portion 120, and the posts are accommodated by holes (not shown) in the printed circuit board 300.

As shown most clearly in FIG. 2, each post 127 includes an upper portion 128 having a diameter that is slightly less than the diameter of the hole that accommodates it and having a height slightly greater than the thickness of the printed circuit board 300. In addition, each post includes a lower portion 129 having a diameter somewhat larger than the hole in the printed circuit board 300. Finally, each post 127 is split longitudinally whereby the sides of the lower portion 129 can be deflected inwardly to permit it to pass through the accommodating hole and then return to an undeflected state when the upper portion 128 is positioned within the hole. The lower portion 129 of each post 127 thereby serves to secure the connector to the printed circuit board 300.

Figure 6:
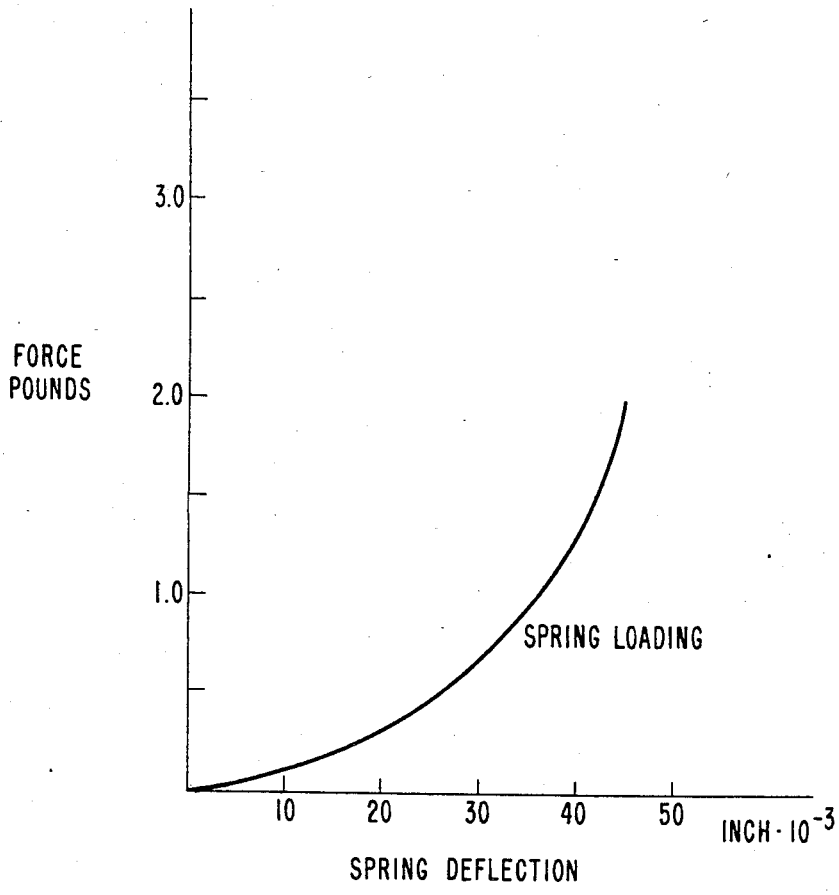
FIG. 6 is a force-deflection diagram for the spring contact of the present invention.

Referring now to FIG. 6, the force-deflection diagram shown there depicts the deflection of a single loop contact portion 230 in the process of the connector being secured to the printed circuit board 300. That is, it depicts the deflection of the loop contact portion 230 from its position in FIG. 4 to its position in FIG. 5. As the locking posts 127 are pushed downwardly through the accommodating holes in the printed circuit board 300, the deflection of the loop contact portion 230 is increased. This deflection reaches its maximum when the bottom surface 122 (FIG. 4) engages the upper surface of the printd circuit board 300.

Once the connector is in place with the lower portion 129 of each locking post 127 returned to its undeflected condition, the downward insertion force is removed from the connector, and the force exerted by the loop contact portion 230 against the printed circuit board 300 moves the connector upwardly until the upper end of the lower portion 129 of the locking posts 127 engages the underside of the printed circit board 300. This takes up any tolerance variation between the thickness of the printed circuit board 300 and the height of the upper portions of 128 of the locking posts 127. The deflection of the loop contact portion 230 is thereby slightly reduced. But the loop contact portion 230, because of the above-described manner in which the spring contact 200 is supported on the support member 100, retains a spring loading in excess of 1.5 pounds. This force provides the contact force neessary to produce a good solderless electrical connection to the conductive path 310 on the printed circuit board 300.

What is claimed is:

1. A spring contact including a loop contact portion having first and second end regions joined by a main region, the first and second end regions being located adjacent to one another and being restrained, and the main region having an arcuate contact surface adjacent to an end region and being free to be deflected about the end regions when the arcuate contact surface is pressed into engagement with another contact element.

2. A spring contact as in claim 1 wherein the main region is free to be deflected about the end regions in a direction generally normal to the arcuate contact surface.

3. A spring contact as in claim 1 wherein the first and second end regions are restrained so as to inhibit their deflection when the arcuate contact surface is pressed into engagement with another contact element.

4. A spring contact as in claim 1 wherein the loop contact portion is generally planar and is restrained in a direction generally normal to its plane.

5. A spring contact as in claim 1 wherein the loop contact portion curves about a central axis and is restrained in a direction parallel to its axis.

6. A spring contact as in claim 1 wherein the spring contact further includes a linear contact portion joined to the loop contact portion by an intermediate portion, the linear contact portion being adapted to make electrical connection with a first contact element and the loop contact portion being adapted to make electrical connection with a second contact element, the first and second contact elements being thereby electrically interconnected.

7. A spring contact assembly comprising:

a spring contact including a loop contact portion having first and second end regions joined by a main region, the first and second end regions being located adjacent to one another and being restrained, and the main region have an arcuate contact surface adjacent to an end region and being free to be deflected about the end regions when the arcuate contact surface is pressed into engagement with another contact element; and a dielectric member on which the spring contact is supported, the support member including a base portion having top and bottom surfaces and an opening extending therebetween within which the first end region of the loop contact portion is situated, the support member cooperating with the spring contact to restrain the first end region.

8. A spring contact assembly as in claim 7 wherein the support member further includes a groove in the bottom surface of the base portion that accommodates the second end region of the loop contact portion, the groove cooperating with the second end region to restrain the second end region.

9. A spring contact assembly as in claim 8 wherein the support member further includes a planar slot within the base portion that extends between the top and bottom surfaces of the base portion, the slot having spaced sides between which the main region of the loop contact portion is partially accommodated, the main region being restrained in a lateral direction by the sides of the slot but being free to be deflected in the plane of the slot.

10. A spring contact assembly as in claim 9 wherein the spring contact further includes a linear contact portion joined to the loop contact portion by an intermediate portion, the intermediate portion being situated in a groove in the bottom surface of the support member and the linear contact portion extending into a cavity in the support member.

11. An electrical connector comprising:

a multiple of spring contacts, each spring contact including a planar loop contact portion having first and second end regions joined by a main region, the first and second end regions being located adjacent to one another; and a dielectric member for supporting the multiple of spring contacts, the support member having means for inhibiting movement of the first and second end regions of each loop contact portion within its plane and having means for inhibiting movement of the main region of each loop contact portion transverse to its plane but permitting movement of the main region of each loop contact portion within its plane.

12. A connector as in claim 11 wherein the support member includes a base portion having a top and a bottom surface and the means for inhibiting movement of the second end region of each loop contact portion within its plane comprises an array of grooves in the bottom surface, the grooves being respectively located adjacent to the array of openings, and the second end region of each loop contact portion being accommodated by an individual groove.

13. A connector as in claim 11 wherein the support member includes a base portion having a top and a bottom surface and the means for inhibiting movement of the main region of each contact portion transverse to its plane but permitting movement within its plane comprises an array of slots that extend between the top and bottom surfaces of the base portion, the main region of each loop contact portion being partially accommodated within an individual slot.

14. A connector as in claim 11 wherein each spring contact has the loop contact portion at one end and a second contact portion at the other end and wherein the support member includes means for coupling with a mating connector, the second contact portion of the spring contacts being located with respect to the coupling means so as to engage contact elements on the mating connector.

15. A connector as in claim 11 wherein the support member includes a base portion having top and bottom surfaces and the means for inhibiting movement of the first end region of each loop contact portion within its plane comprises an array of openings that extend between the top and bottom surfaces of the base portion, the first end region of each loop contact portion being situated within an individual opening.

16. A connector as in claim 15 wherein the means for inhibiting movement of the second end region of each loop contact portion within its plane comprises an array of grooves in the bottom surface, the grooves being respectively located adjacent to the array of openings and the second end region of each loop contact portion being accommodated by an individual groove.

17. A connector as in claim 16 wherein the means for inhibiting movement of the main region of each contact portion transverse to its plane but permitting movement within its plane comprises an array of slots that extend between the top and bottom surfaces of the base portion, the main region of each loop contact portion being partially accommodated within an individual slot.

18. A connector as in claim 17 wherein each spring contact further includes a linear contact portion joined to the loop contact portion by an intermediate portion, the intermediate portion being joined to the first end region of the loop contact portion and wherein the base portion of the support member includes an array of grooves in its bottom surface, each intermediate portion being accommodated within an individual groove.

19. A connector as in claim 18 wherein the support member includes a cavity for accommodating a mating connector and the base portion of the support member serves as the bottom of the cavity, the linear contact portion of each spring contact extending into the cavity for engaging a contact element on the mating connector.

20. An electrical connector for making solderless electrical connection with conductive paths on a printed circuit board and for interconnecting a mating connector to the conductive paths, the connector comprising:

A multiple of spring contacts, each spring contact comprising a linear contact portion at one end that is joined by an intermediate portion to a planar loop contact portion at the other end, the loop contact portion having first and second end regions joined by a main region, the first end region being joined to the intermediate portion of the spring contact, the second end region being located adjacent to the first end region, and the main region having a contact surface adjacent to the second end region;

a dielectric member for supporting the multiple of spring contacts; the support member including a generally rectangular cavity adapted to accommodate a mating plug, the support member further including a planar base portion that serves as the bottom of the cavity, the base portion having:

a top and a bottom surface, the bottom surface being adapted to overlie the associated printed circuit board, an array of spaced openings extending between the top and bottom surfaces within which openings the first end regions of and the loop contact portions are respectively situated, an array of spaced slots extending between the top and bottom surfaces within which the main regions of the loop contact portions are respectively partially accommodated, an array of spaced first grooves in the bottom surface, the first grooves being located between the slots and the openings, the first grooves respectively accommodating the second end regions of the loop contact portions, and an array of spaced second grooves in the bottom surface for respectively receiving the intermediate portions of the spring contacts.

* * * * *